US007536734B2

(12) United States Patent
Heimbrock

(10) Patent No.: US 7,536,734 B2
(45) Date of Patent: May 26, 2009

(54) BIRTHING SUPPORT APPARATUS

(75) Inventor: Richard H. Heimbrock, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 317 days.

(21) Appl. No.: 11/275,688

(22) Filed: Jan. 24, 2006

(65) Prior Publication Data

US 2006/0168727 A1 Aug. 3, 2006

Related U.S. Application Data

(60) Provisional application No. 60/648,632, filed on Jan. 31, 2005.

(51) Int. Cl.
*A61G 7/047* (2006.01)

(52) U.S. Cl. ..... 5/602; 5/621; 5/624

(58) Field of Classification Search ..... 5/602, 5/621–624; 248/160; 602/33
See application file for complete search history.

(56) References Cited

U.S. PATENT DOCUMENTS

| | | | |
|---|---|---|---|
| 0,388,995 | A | 9/1888 | Moxham |
| 0,964,170 | A | 7/1910 | Leonard |
| 1,469,841 | A | 10/1923 | Lazar |
| 1,469,928 | A | 10/1923 | Lazar |
| 1,835,021 | A | 12/1931 | Decker |
| 1,930,993 | A | 10/1933 | Blodgett |
| 2,067,891 | A | 1/1937 | Comper |
| 2,120,732 | A | 6/1938 | Comper et al. |
| 2,257,491 | A | 9/1941 | Armstrong |
| 2,275,973 | A | 3/1942 | Marchbanks |
| 2,306,031 | A | 12/1942 | Anderson et al. |
| 2,381,633 | A | 8/1945 | Young |
| 2,470,524 | A | 5/1949 | Scudder |
| 2,605,151 | A | 7/1952 | Shampaine |
| 2,640,998 | A | 6/1953 | Myre |
| 2,658,211 | A | 11/1953 | Bendersky |
| 2,754,142 | A | 7/1956 | Baker, Jr. |
| 2,757,058 | A | 7/1956 | Broesel |
| 2,766,463 | A | 10/1956 | Bendersky |
| 2,832,655 | A | 4/1958 | Adolphson |
| 2,872,259 | A | 2/1959 | Thorpe |
| 3,100,129 | A | 8/1963 | Adolphson |

(Continued)

FOREIGN PATENT DOCUMENTS

DE 1098671 2/1961

(Continued)

OTHER PUBLICATIONS

English translation of patent abstract for Japanese publication No. 03295937A, 1 page.

(Continued)

*Primary Examiner*—Fredrick Conley
(74) *Attorney, Agent, or Firm*—Barnes & Thornburg LLP

(57) ABSTRACT

A stirrup apparatus for use on a birthing bed is provided. The support apparatus has a bracket configured to be coupled to the birthing bed, an adjustable length member, and a foot support. The bracket is pivotable in a plurality of axes to allow the support apparatus to be adjusted. The stirrup apparatus may provide lateral support for a leg of a patient.

24 Claims, 4 Drawing Sheets

U.S. PATENT DOCUMENTS 3,167,789 A 2/1965 Wicks
3,220,022 A 11/1965 Nelson
3,226,105 A 12/1965 Weickgenannt et al.
3,227,440 A 1/1966 Scott
3,231,905 A 2/1966 Brochu
3,318,596 A 5/1967 Herzog
3,334,951 A 8/1967 Douglass, Jr. et al.
3,492,679 A 2/1970 Drew
3,587,592 A 6/1971 Price et al.
3,599,963 A 8/1971 Grover
3,733,481 A 5/1973 Kuyt
3,764,795 A 10/1973 Austin, Jr.
3,813,091 A 5/1974 Metzger
3,817,512 A 6/1974 Torrey
3,845,945 A 11/1974 Lawley et al.
3,868,103 A 2/1975 Pageot et al.
3,997,926 A 12/1976 England
4,025,972 A 5/1977 Adams et al.
4,097,939 A 7/1978 Peck et al.
4,139,917 A 2/1979 Fenwick
4,148,472 A 4/1979 Rais et al.
4,178,625 A 12/1979 Schudel
4,225,126 A 9/1980 Lee
4,225,127 A 9/1980 Strutton
4,233,649 A 11/1980 Scheer et al.
4,247,091 A 1/1981 Glowacki et al.
4,323,060 A * 4/1982 Pecheux ..... 602/33
4,333,638 A 6/1982 Gillotti
4,336,965 A 6/1982 Lipp
4,395,071 A 7/1983 Laird
4,407,277 A 10/1983 Ellison
4,411,035 A 10/1983 Fenwick
4,426,071 A 1/1984 Klevstad
4,457,502 A 7/1984 Beach
4,552,348 A 11/1985 Forssmann et al.
4,564,164 A 1/1986 Allen et al.
4,577,730 A 3/1986 Porter
4,615,058 A 10/1986 Feldt
4,632,349 A 12/1986 Anstey
4,639,954 A 2/1987 Speed
4,682,376 A 7/1987 Feldt
4,688,780 A 8/1987 Hanz
4,698,837 A 10/1987 Van Steenburg
4,724,555 A 2/1988 Poehner et al.
4,805,249 A 2/1989 Usman et al.
4,807,618 A 2/1989 Auchinleck et al.
4,809,687 A 3/1989 Allen
4,821,350 A 4/1989 Feldt
4,860,394 A 8/1989 Benessis et al.
4,882,566 A 11/1989 Koerber, Sr. et al.
4,882,797 A 11/1989 Failor et al.
4,886,258 A 12/1989 Scott
4,894,876 A 1/1990 Fenwick
4,898,491 A 2/1990 Van Steenburg
4,913,413 A 4/1990 Raab
4,940,218 A 7/1990 Akcelrod
4,968,013 A 11/1990 Kuck
4,993,762 A 2/1991 Rogers et al.
5,039,167 A 8/1991 Sweet
5,060,327 A 10/1991 Celestina et al.
5,104,363 A 4/1992 Shi
5,109,554 A 5/1992 Borders et al.
5,116,008 A 5/1992 Allen
5,129,116 A 7/1992 Borders et al.
5,129,117 A 7/1992 Celestina et al.
5,134,737 A 8/1992 Wyman
5,134,739 A 8/1992 Gaffe et al.
5,148,562 A 9/1992 Borders et al.
5,157,800 A 10/1992 Borders
5,201,087 A 4/1993 Wickham et al.
D336,577 S 6/1993 Celestina et al.
D336,578 S 6/1993 Celestina
5,214,812 A 6/1993 Bartow et al.
5,226,187 A 7/1993 Borders et al.
5,287,575 A 2/1994 Allen et al.
5,329,657 A 7/1994 Bartley et al.
5,331,698 A 7/1994 Newkirk et al.
5,362,302 A 11/1994 Jensen et al.
5,369,827 A 12/1994 Parke et al.
5,398,357 A 3/1995 Foster
5,423,097 A 6/1995 Brule et al.
5,454,126 A 10/1995 Foster et al.
5,466,249 A 11/1995 de Putter
5,472,412 A 12/1995 Knoth
5,479,666 A 1/1996 Foster et al.
5,481,770 A 1/1996 Ahlsten
5,560,577 A 10/1996 Keselman
5,582,379 A 12/1996 Keselman et al.
5,628,078 A 5/1997 Pennington et al.
5,636,899 A 6/1997 Schiff et al.
5,645,079 A 7/1997 Zahiri et al.
5,661,859 A 9/1997 Schaefer
5,692,255 A 12/1997 Canfield
5,740,571 A 4/1998 Tyra
5,740,572 A 4/1998 Hannant
5,758,374 A 6/1998 Ronci
5,774,914 A 7/1998 Johnson et al.
5,778,467 A 7/1998 Scott et al.
5,791,761 A 8/1998 Bryant et al.
5,802,641 A 9/1998 Van Steenburg
5,862,549 A 1/1999 Morton et al.
5,878,748 A 3/1999 Garth et al.
5,913,774 A 6/1999 Feddema
5,918,330 A 7/1999 Navarro et al.
5,926,878 A 7/1999 Morton et al.
5,941,175 A 8/1999 Bannister
5,961,085 A 10/1999 Navarro et al.
6,058,534 A 5/2000 Navarro et al.
6,112,345 A 9/2000 Foster et al.
6,141,806 A 11/2000 Bobey et al.
6,202,230 B1 3/2001 Borders
6,226,821 B1 5/2001 Heimbrock et al.
6,263,531 B1 7/2001 Navarro et al.
6,282,738 B1 9/2001 Heimbrock et al.
6,412,126 B2 7/2002 Heimbrock et al.
6,618,882 B2 9/2003 Heimbrock et al.
6,691,350 B2 2/2004 Weismiller
6,698,044 B2 * 3/2004 Greenfield et al. ..... 5/624
6,718,580 B2 4/2004 Heimbrock et al.
6,725,479 B1 4/2004 Stryker et al.
6,754,923 B2 6/2004 Borders et al.
6,846,042 B2 1/2005 Hanson et al.
6,851,142 B2 2/2005 Strkyer et al.
6,948,202 B2 9/2005 Weismiller
6,957,457 B2 10/2005 Stryker et al.
6,983,501 B2 1/2006 Heimbrock et al.
2004/0148705 A1 8/2004 Stryker et al.
2004/0163177 A1 8/2004 Stryker et al.
2006/0016010 A1 1/2006 Weismiller
2006/0070182 A1 4/2006 Heimbrock et al.
2006/0117485 A1 6/2006 Brophy et al.
2006/0225215 A1 10/2006 Krecow et al.

FOREIGN PATENT DOCUMENTS

DE 2324486 12/1973
DE 2911743 10/1979
DE 3500313 7/1985
DE 198 53 270 A1 5/2000
EP 0376066 12/1989
EP 0681799 5/1995
EP 0845254 6/1998
FR 1518724 12/1966
FR 2061319 6/1971

| | | |
|---|---|---|
| FR | 2666013 | 2/1992 |
| GB | 2 067 414 A | 7/1981 |
| GB | 2225228 | 5/1990 |
| JP | 531145 | 1/1978 |
| JP | 56109663 | 8/1981 |
| JP | 60145138 | 7/1985 |
| JP | 60195018 | 10/1985 |
| JP | 612755 | 1/1986 |
| JP | 61119257 | 6/1986 |
| JP | 61168351 | 7/1986 |
| JP | 2147120 | 6/1990 |
| JP | 2297366 | 12/1990 |
| JP | 2297367 | 12/1990 |
| JP | 2297368 | 12/1990 |
| JP | 685749 | 3/1994 |
| JP | 6122577 | 5/1994 |
| JP | 6144019 | 5/1994 |
| JP | 6150626 | 5/1994 |
| JP | 7112012 | 5/1995 |
| WO | 9218082 | 10/1992 |
| WO | 0007537 | 2/2000 |

OTHER PUBLICATIONS

English translation of patent abstract for Japanese publication No. 03004809A, 1 page.

English translation of patent abstract for Japanese publication No. 03004808A, 1 page.

* cited by examiner

BIRTHING SUPPORT APPARATUS

RELATED APPLICATIONS

This application claims the benefit, under 35 U.S.C. § 119(e), of U.S. Provisional Patent Application Ser. No. 60/648,632 filed Jan. 31, 2005 which is hereby incorporated by reference herein in its entirety.

BACKGROUND OF THE INVENTION

The present disclosure relates to accessories for hospital beds. More specifically, the disclosure relates to a leg support apparatus used on birthing and other hospital beds and patient support devices.

Hospital beds used as patient supports are well known. It is also known to perform various medical procedures on hospital beds. In some cases, the beds are configured to facilitate the procedures. This may include the addition of leg supports, stirrup devices, and articulating members.

Birthing leg supports are used, for example, to support a patient's feet and/or legs during the birthing process. These birthing bed leg supports are often attached to the birthing bed near the foot end of the birthing bed. Some leg supports provide adjustable support of a patient's feet. Other leg supports provide support of the patient's calf area holding the patient's leg in an elevated orientation.

SUMMARY OF THE INVENTION

The present disclosure comprises one or more of the features recited in the appended claims and/or the following features which, alone or in any combination, may comprise patentable subject matter:

An adjustable birthing support apparatus for use on a hospital birthing bed is provided to support a patient's legs while in the birthing bed. The support apparatus includes a first bracket, a telescoping strut, a flexible leg support, and a pivoting foot rest. As the strut telescopes, the curvature of the flexible leg support may change. The flexible leg support may also be positioned to provide lateral support to the patient's leg.

The first bracket may be configured to be attached to the birthing bed. A first end of the telescoping strut is coupled to the first bracket. The telescoping strut may be a hydraulic or pneumatic cylinder, a linear actuator, or an un-powered strut. In some embodiments, the strut may be a combination of a hydraulic/pneumatic device wherein the strut is pre-charged with gas to provide assistance in repositioning the birthing support apparatus. In other embodiments, the telescoping strut may be spring-loaded to provide a bias to assist a caregiver in adjusting the position of the birthing support apparatus. In embodiments where the telescoping strut is biased to provide assistance, the strut is lockable to prevent the bias from pushing the legs of the patient upward. The bias may be of a suitable force to support a portion of the weight of a patient's leg thereby assisting a caregiver in repositioning the leg of a patient.

Illustratively, the flexible leg support includes a first end coupled to the first end of the telescoping strut and a second end coupled to a second end of the telescoping strut. The flexible leg support may include a flexion rod, a chain, and foam covering both the flexion rod and the chain. The flexible leg support may be bendable in a single direction about one axis and is configured to support a lateral load placed against the flexible leg support by a patients leg or knee. As the telescoping strut changes length, the curvature of the flexible leg support may change as well. For example, extension of the telescoping strut may result in straightening of the flexible leg support and retraction of the telescoping strut may result in increased curvature of the flexible leg support.

A pivoting foot rest may be coupled to the second end of the telescoping strut and the second end of the flexible leg support. The pivoting foot rest may pivot relative to the telescoping strut so that the patient's foot is comfortably supported in all elevations of the birthing support apparatus. When the patient's foot is supported by the pivoting foot rest, the birthing support apparatus acts in a manner similar to a traditional ob/gyn stirrup apparatus.

The birthing support apparatus may include a two-axis pivot bracket configured to be coupled to the birthing bed or specifically to a hip area of the birthing bed. When present, the two-axis pivot bracket is coupled to the first bracket of the birthing support apparatus. The two-axis pivot bracket allows portions of the birthing support apparatus to pivot about a first axis parallel to the longitudinal length of the birthing bed. Portions of the birthing support apparatus may be pivoted about the first axis between a use position wherein the flexible support apparatus is generally above the deck of the birthing bed and a stowed position wherein the birthing support apparatus is in a position below the deck of the birthing bed. The two-axis pivot bracket also allows portions of the birthing support apparatus to pivot about a second axis perpendicular to the longitudinal length of the birthing bed and the first axis and in a plane that is parallel to the floor. Pivoting portions of the birthing support apparatus about the second axis allows the patient's feet to be raised or lowered relative to the elevation of the patient's hips.

The support apparatus may further include a ball-and-socket coupler coupled to the first bracket and configured to be attached to the hip area of the birthing bed. The ball-and-socket coupler permits the birthing support apparatus to be adjusted in a plurality of directions. For example, the ball-and-socket coupler allows portions of the birthing support apparatus to be pivoted between a use position and the stowed position. Also, the pivoting of the birthing support apparatus may be used to control the adduction or abduction of a patient's legs while the flexible leg support acts as an abduction support. The ball-and-socket coupler may include a locking mechanism which locks the birthing support apparatus in any position.

The birthing support apparatus may also include a release handle coupled to the second end of the telescoping strut. The release handle may be operable to release a lock of the telescoping strut which maintains a length of the telescoping strut. The release handle may also be operable to simultaneously release both the telescoping strut and the two-axis pivot bracket so that the position of the leg support of the birthing support apparatus is adjustable when the release handle is engaged. The release handle may also be operable to release the ball-and-socket coupler when the ball-and-socket coupler is present.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
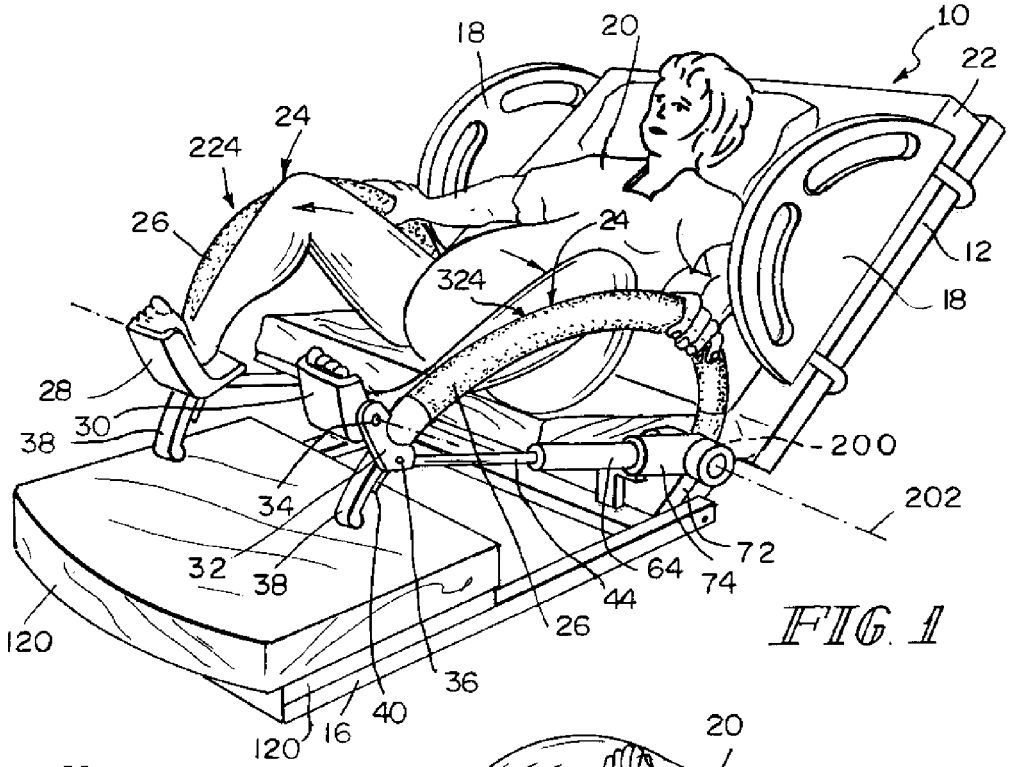
FIG. 1 is a perspective view of a patient on a birthing bed showing a birthing support apparatus of the present disclosure coupled to a hip area of the birthing bed and further showing the support apparatus in a first retracted position such that the patient's legs are bent.

A birthing support apparatus 24 is coupled to a birthing bed 10, as shown in FIGS. 1-5, to support a patient's legs thereon in a variety of positions, as is discussed in greater detail below. Illustratively, the birthing bed 10 includes multiple frame members such as a head frame 12, a seat frame 14, and a foot frame 16. A partial mattress 22 is located on the head frame 12 and seat frame 14. Another partial mattress 120 is located on the foot frame 16, as shown in FIG. 1. The birthing bed 10 also has two siderails 18 coupled to the head frame 12. The birthing support apparatus 24 may be either a right-hand version 224 shown in FIGS. 1 and 5 for attachment to the bed to the right side of the patient when in the bed or a left-hand version 324 shown in FIGS. 1 and 5 for attachment to the bed to the left side of the patient when in the bed and discussed throughout, with the two versions being substantially similar in operation and construction. For clarity, the support apparatus will be identified by the reference designator 24 throughout the remainder of the disclosure.

The birthing support apparatus 24 includes a two-axis pivot bracket 72, a telescoping strut 42 coupled at a first end to the two-axis pivot bracket 72, a flexible leg support 26 coupled at a first end to the two-axis pivot bracket 72, and a mounting bracket 32 coupled to the second ends of the telescoping strut 42 and the flexible leg support 26. The birthing support apparatus 24 further includes a release handle 38 coupled to the mounting bracket 32, and a foot rest 28 or 30 pivotably coupled to the mounting bracket 32. Depending on orientation (i.e. whether the birthing support apparatus 24 is coupled to the right or left side of the birthing bed 10), the foot rest is either a left foot rest 30 or a right foot rest 28. In the illustrative embodiment of FIG. 1, the birthing support apparatus 24 is pivotable about two axes 200, 202 to provide for elevation of a patient's feet and rotation of the flexible leg support 26 to allow the patient's knees to open laterally to provide better access to the pelvic area of the patient 20. Additionally, a length of the birthing support apparatus 24 is adjustable to allow the patient 20 to extend or retract her legs. This is accomplished through adjustment of the telescoping strut 42 of the birthing support apparatus 24.

More specifically, the telescoping strut 42 includes an extension tube 64 and an extension rod 44. The extension tube 64 is configured such that the inner diameter of extension tube 64 is slightly larger than the outside diameter of the extension rod 44 so that the extension rod 44 is telescopically received within the extension tube 64. The extension tube 64 is connected at a first end to the two-axis pivot bracket 72 and the extension rod is pivotably coupled at a second end to the mounting bracket 32 by a pin 36. Telescopic movement of extension rod 44 within extension tube 64 changes the length of the telescoping strut 42 which results in the movement of the mounting bracket 32 toward or away from the two-axis pivot bracket 72. Illustratively, the telescoping strut 42 may be a hydraulic or pneumatic cylinder, a linear actuator, or an un-powered strut. In some embodiments, the strut may be a combination of a hydraulic/pneumatic device wherein the strut is pre-charged with gas to provide positioning assistance. In other embodiments, the telescoping strut may be spring loaded to provide positioning assistance. In embodiments where the telescoping strut is biased, the strut is lockable to maintain a specific position. The bias may be of a suitable force to support a portion of the weight of a patient's leg thereby assisting a caregiver in repositioning the leg of a patient.

The flexible leg support 26 is also coupled at a first end to the two-axis pivot bracket 72 and at a second end to the mounting bracket 32. Illustratively, the flexible leg support 26 has a fixed length. The flexibility or bendability of the flexible leg support 26 allows the flexible leg support 26 to be bent or curved into various sized arcs. As the telescoping strut 42 telescopically retracts, the distance between a mid-point of the flexible leg support 26 and the telescoping strut 42 increases to create a narrower arc. As the telescoping strut 42 telescopically extends, the distance between the mid-point of the flexible leg support 26 and the telescoping strut 42 decreases to create a wider arc. The flexible leg support 26 is sized such that an apex of the curvature of the flexible leg support 26 varies as the curvature of the leg support varies to remain generally adjacent to the knee of a patient 20 reclining on the birthing bed 10 as the patient's leg is extended or retracted.

Figure 2:
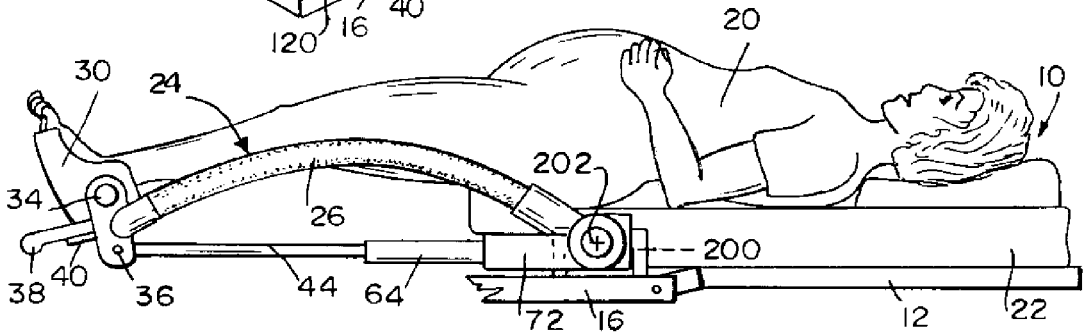
FIG. 2 is a side view of the bed and support apparatus of FIG. 1 showing the support apparatus in an extended position to support the patient's legs when they are straightened and further showing a flexible leg support of the support apparatus adjacent the knee.
Figure 3:
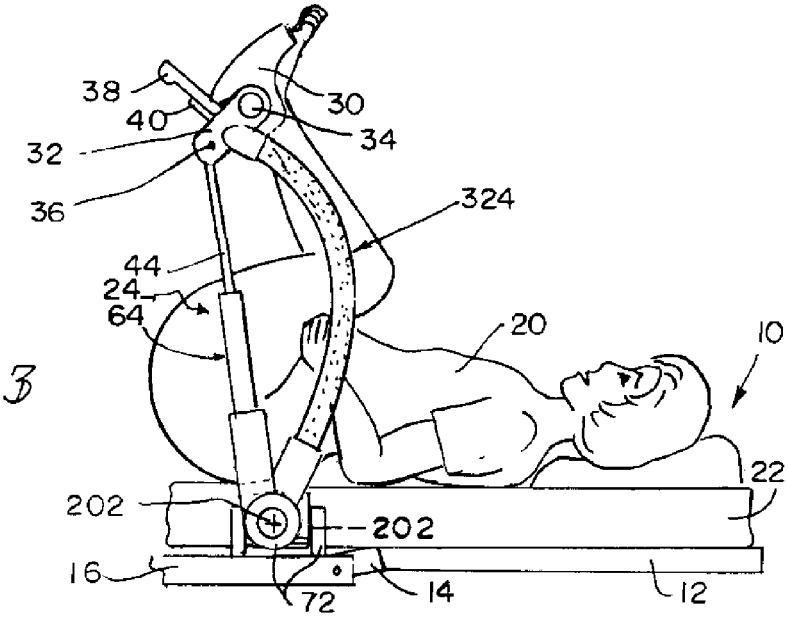
FIG. 3 is a side view of the bed and support apparatus of FIG. 1 showing a portion of the support apparatus having been pivoted about a first axis upwardly to a vertical position to support the legs of the patient in a vertical orientation.

The two-axis pivot bracket 72 pivots about a first axis 200 parallel to a longitudinal length of the birthing bed 10 and a second axis 202 perpendicular to the first axis 200 as shown in FIG. 1. Pivoting of the telescoping strut 42 and flexible leg support 26 about the second axis 202 results in altering the angle between a seat frame 14 of the birthing bed 10 and the telescoping strut 42. This allows the patient's feet to be positioned in various positions above and below the plane in which the seat frame 14 lies. As shown in FIG. 2, the telescoping strut 42 may be positioned to be parallel to the plane of the seat frame 14. FIG. 3 shows the telescoping strut 42 pivoted about axis 202 such that the telescoping strut 42 is pivoted upwardly to be generally perpendicular to the plane of the seat frame 14.

Figure 4:
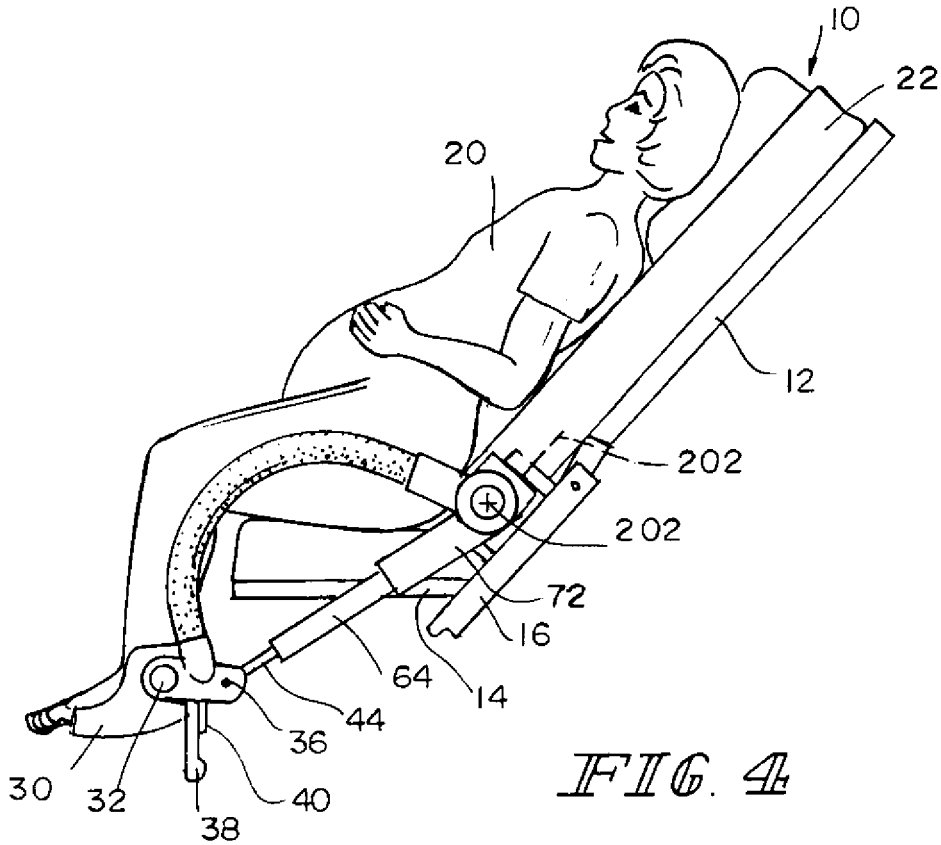
FIG. 4 is a side view of the bed and support apparatus of FIG. 1 showing a portion of the support apparatus having been pivoted downwardly about the first axis to support the patient's legs when the patient is in a seated position.

A typical birthing bed has a removable foot frame 120 so as to provide access to a patient's pelvic area for caregivers such as doctors and nurses. FIG. 4 shows the birthing bed 10 with a portion of the foot frame 16 removed and the birthing support apparatus 24 rotated about axis 202 such that the patient's 20 feet are below the plane of the seat frame 14, thereby allowing the patient 20 to achieve a sitting position. It should also be noted that the left foot rest 30 has pivoted on pin 34 to achieve an appropriate position for the patient's 20 foot.

Figure 5:
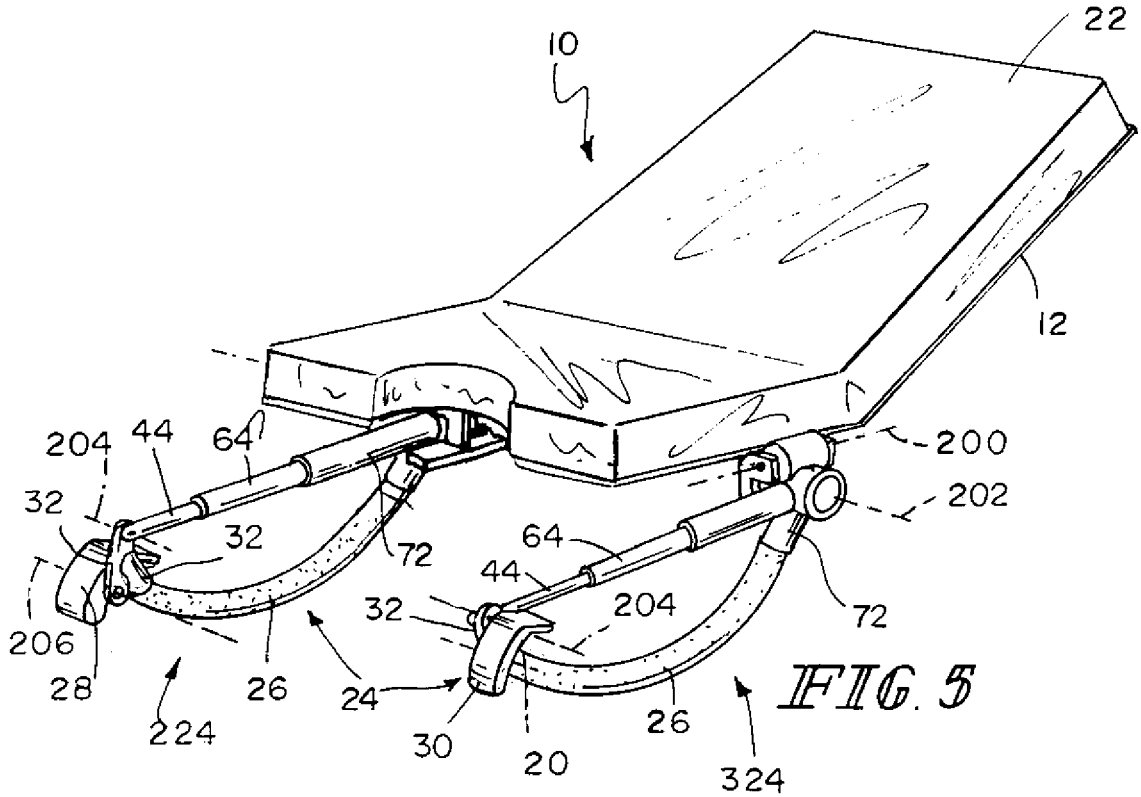
FIG. 5 is a perspective view of the birthing bed and support apparatus showing a portion of the support apparatus having been rotated 90 degrees about a second axis to a storage position.

Two-axis pivot bracket 72 also pivots about the first axis 200 in the illustrative embodiment of FIGS. 1-5. Illustratively, telescoping strut 42 and flexible leg support 26 are pivotable about the first axis 200 between a use position, shown in FIGS. 1-4, and a stowed position shown in FIG. 5. In the use position, the flexible leg support 26 may be used to support a patient's knee to control abduction and is generally oriented such that the flexible leg support 26 is positioned above the telescoping strut to support a patient's knee thereon. In the stowed position, the telescoping strut 42 and flexible leg support 26 have been pivoted about the first axis 200 in a direction away from the bed 10 to be stowed generally below the bed 10 and out of the way such that the flexible leg support 26 is positioned below the telescoping strut 24. FIG. 5 shows the telescoping strut 42 and flexible leg support 26 in a stowed position wherein the telescoping strut 42 and flexible leg support 26 have been pivoted about axis 200 such that telescoping strut 42 and flexible leg support 26 are beneath the plane of the seat frame 14. In the stowed position, the telescoping strut 42 and flexible leg support 26 is out of the way of the patient 20 and any caregivers who need access to the patient 20. Either one or both of the support apparatuses 24 may be independently moved between any use position and the stowed position of FIG. 5.

Figure 6:
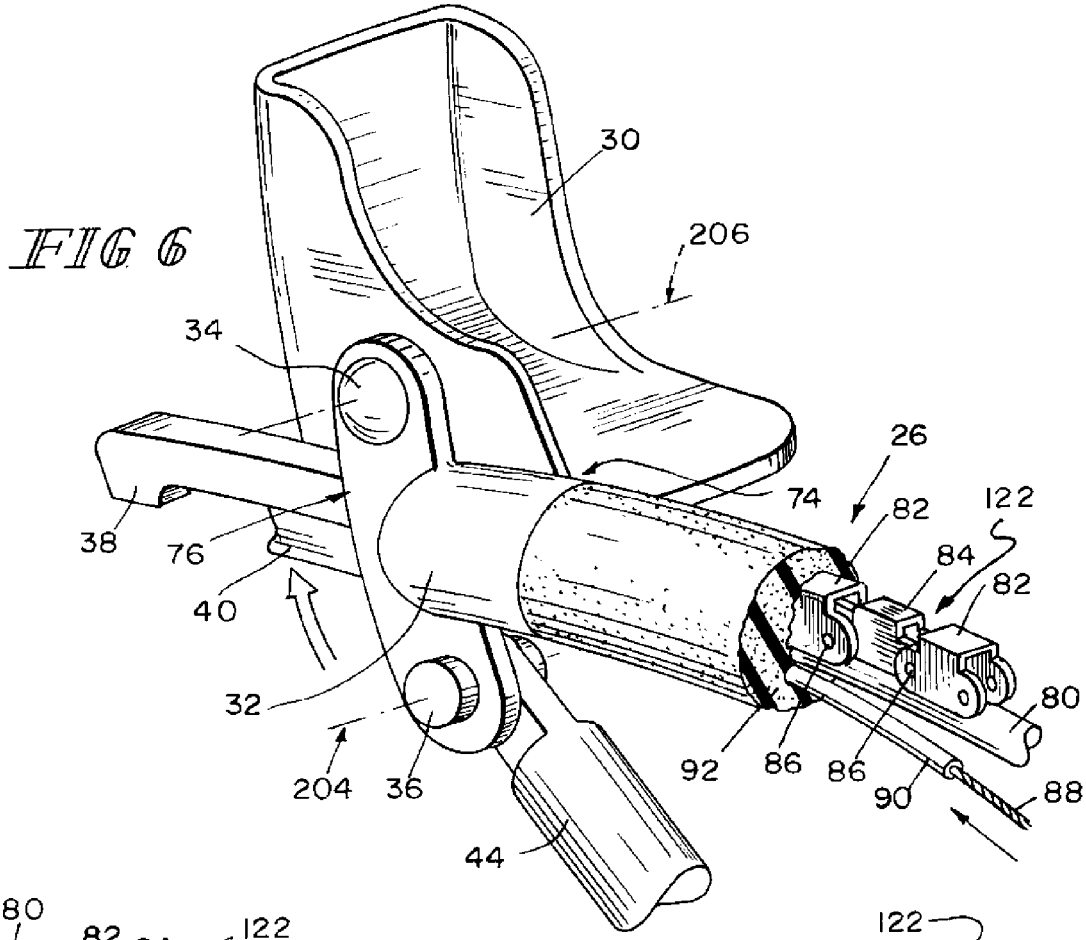
FIG. 6 is a perspective view of a freely pivoting foot rest of the support apparatus as well as a trigger release mechanism for unlocking the various locking mechanisms of the support apparatus.
Figure 7:
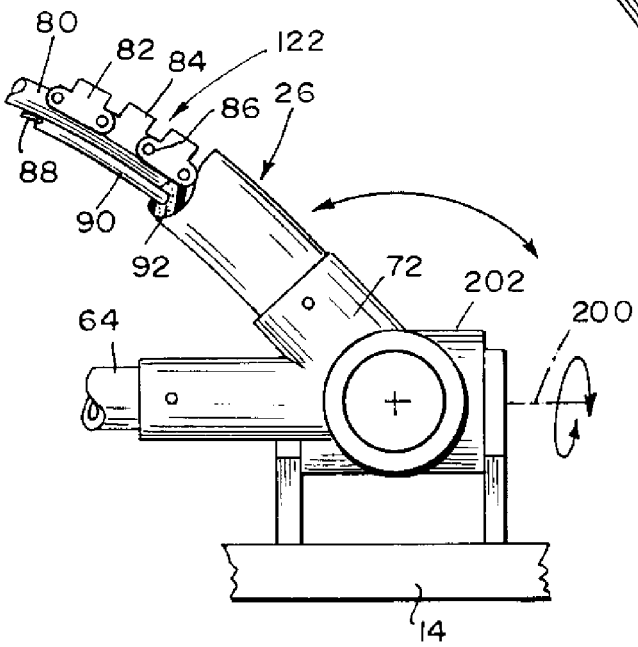
FIG. 7 is a side view of a proximal end of the support apparatus showing a two-axis pivot bracket of the support apparatus coupled to the bed to allow portions of the support apparatus to pivot about a second axis between a use position (as shown in FIGS. 1-4) and the storage position (shown in FIG. 5) and the first axis to move the support apparatus through various use positions as needed for the patient.
Figure 8:
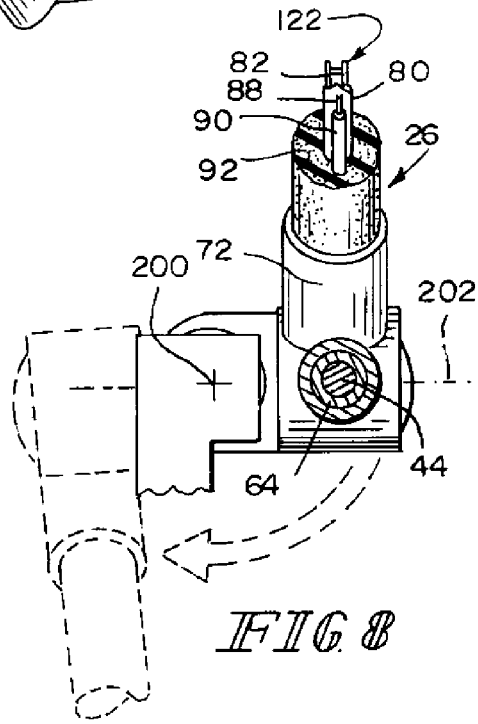
FIG. 8 is an end view of the two-axis pivot bracket showing the support apparatus in the use position and showing in phantom portions of the support apparatus rotated to the storage position.

FIG. 6 shows an enlarged view of a second end of the birthing support apparatus 24. Mounting bracket 32 has a cup portion 74 and a flange portion 76. The flange portion 76 has two holes (not shown) that receive two pins 34, 36. The extension rod 44 is pivotably coupled to the mounting bracket 32 by the first pin 36. The centerline of pin 36 forms a pivot axis 204 about which the rod 44 is able to pivot. The extension rod 44 pivots about axis 204 as the birthing support apparatus 24 is articulated or telescoped. The foot rest 30 is pivotably coupled to the mounting bracket 32 by a second pin 34. The foot rest 30 is pivotable about an axis 206 which is formed by the centerline of pin 34. The flexible leg support 26 is coupled to the mounting bracket 32 at a cup portion 74 of the bracket. Because the flexible leg support 26 is fixed to mounting bracket 32, the pivoting motion of extension rod 44 about axis 204 results in a change of the angle between a centerline of the flexible leg support 26 and the extension rod 44.

Flexible leg support 26 includes a flexion rod 80 and a chain 122. The flexion rod 80 forms a support for the chain 122 which includes multiple large links 82 and multiple small links 84 being coupled in a chain which engages the flexion rod 80. The large links 82 are sized to receive the small links 84 in each end of the large link 82. Both the large links 82 and small links 84 have through holes 94 which are configured to receive a pin 86 through the hole 94 so that the links 82, 84 are coupled together and pivotable relative to each other about the pins 84. A first end of the flexion rod 80 and a first end of the chain of links 82, 84 are coupled to the two-axis pivot bracket 72. A second end of the flexion rod 80 and a second end of the chain 122 of links 82, 84 are coupled to the mounting bracket 32. The resulting structure limits the range of flexure of the flexible leg support 26 to flex substantially within a plane formed through the centerline of the flexion rod 80 and the telescoping strut 42. This angle of curvature defines the shape of the flexible leg support 26 when the telescoping strut 42 is extended or retracted. The curvature, measured by the tendency at any point to depart from a tangent drawn to the curve at that point increases as the telescoping strut 42 is retracted and decreases as the telescoping strut 42 is extended. In addition, the combination of the chain of links 82, 84 engaged with the flexion rod 80 resists outward deflection from the plane formed through the centerline of the flexion rod 80 and the telescoping strut 42 and therefore provides lateral support when a patient 20 places their leg or knee against the flexible leg support 26 as shown in FIG. 1.

In use, the flexible leg support 26 is positioned to support the knee of the patient 20 as the apparatus 24 is moved throughout the range of positions achieved due to the extension and retraction of the telescoping strut 42. A foam covering 92 provides a cushion for the patient's leg or knee. A cable 88 received within the foam covering 92, is connected to a release trigger 40 at one end and is connected to one or more brake mechanisms on a second end near the two-axis pivot bracket 72. A release handle 38 is coupled to the mounting bracket 32. The release trigger 40 is pivotably coupled to the release handle 38. The combination of the release handle 38, release trigger 40, and cable 88 work together to release the locking mechanisms to allow the free movement of a portion of the birthing support apparatus 24 about first and second axes 200, 202. A cable sheath 90 is configured to allow the cable 88 to move freely without snagging or damaging the foam covering 92 or other parts of the birthing support apparatus 24.

The activation of the release trigger 40 results in the release trigger 40 pivoting about a pin (not shown) which couples the release trigger 40 to the handle 38. As the release trigger 40 pivots, the connection point of cable 88 to the release trigger 40 experiences relative movement about the axis formed by the centerline of the pin (not shown). This movement is translated along the cable 88 to release the locking mechanisms (not shown) connected to the two-axis pivot bracket 72. The locking mechanisms lock the telescoping strut 42 to prevent telescopic movement and lock the two-axis pivot bracket 72. The locking mechanisms are typically biased to a locked position such that the release trigger 40 may be activated to release the locking mechanisms. The biasing device returns the locking mechanism to the locked position when the release trigger 40 is released.

Figure 9:
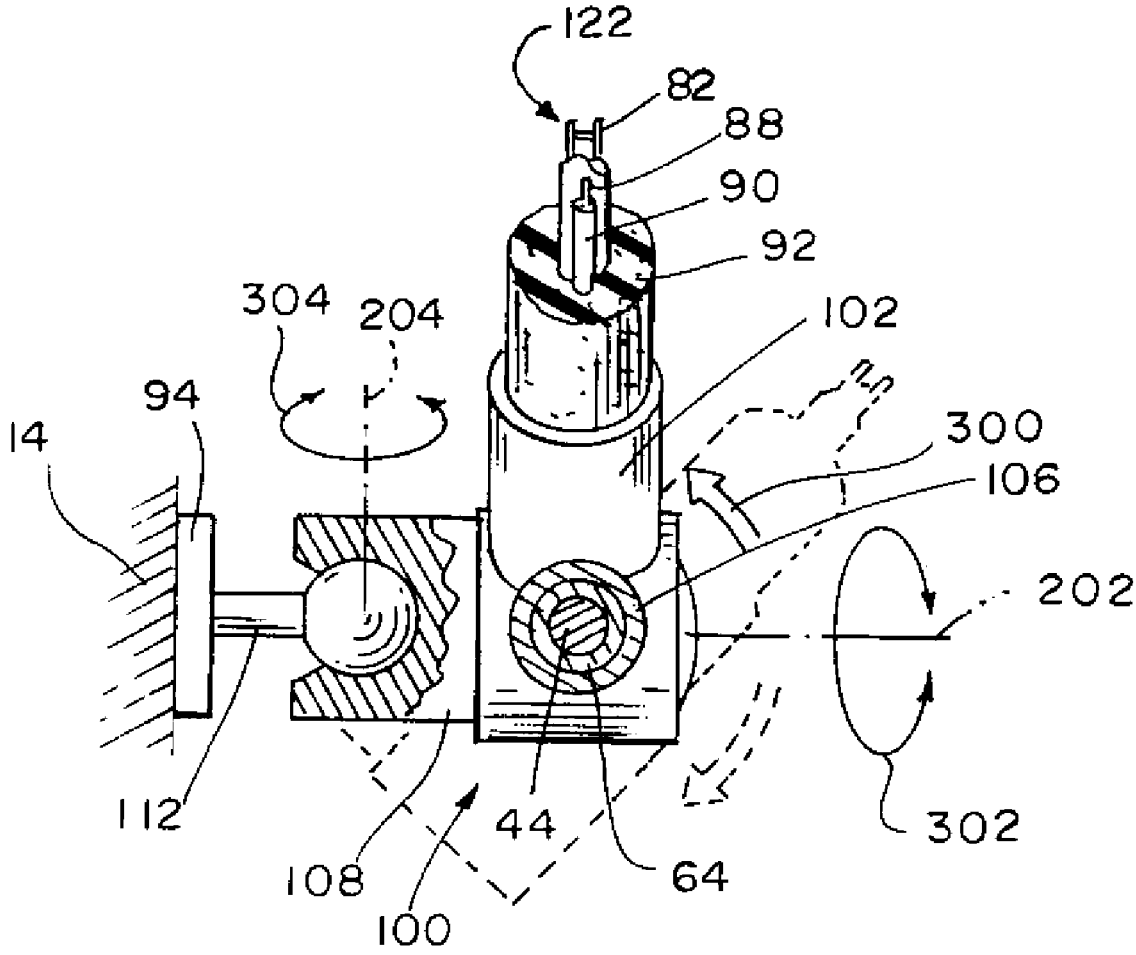
FIG. 9 is an end view of another leg support apparatus including a ball-and-socket coupler mounted to the bed frame to permit rotation of the leg support.

FIG. 9 shows another embodiment of the birthing support apparatus 24 where the two-axis pivot bracket 72 is omitted and replaced with a bracket 100. Bracket 100 has a cup portion 102 which is configured to receive the flexible leg support 26, a main portion 104, and a tube portion 106 which is configured to receive the extension tube 64. A socket portion 108 of bracket 100 is configured to mate with a ball 110 to form a ball-and-socket coupler. The ball 110 is coupled to a bracket 94 by a rod 112. The bracket 94 is configured to be coupleable to the seat frame 14 of the birthing bed 10. The bracket 100 is moveable in all axes about the center of the ball 110 as shown by the arrows 300, 302, 304 which correspond with axes 200, 202, and an axis 208 respectively in FIG. 9.

Utilizing the ball-and-socket configuration of the illustrative embodiment of FIG. 9, the birthing support apparatus 24 is adjustable to multiple positions including all of the positions of the illustrative embodiments of FIGS. 1-5 as well as permitting adjustment of the birthing support apparatus 24 to move a patient's feet inwardly and outwardly in a horizontal plane to provide abduction or adduction of the patient's legs. This provides additional positions for the patient 20 to orient her legs during labor or other procedures.

Although certain illustrative embodiments have been described in detail above, variations and modifications exist within the scope and spirit of this disclosure as described and as defined in the following claims.

The invention claimed is:

1. A support apparatus for use with a birthing bed, the apparatus comprising a telescoping arm, a flexible leg support having a first end coupled to a first end of the telescoping arm and a second end coupled to a second end of the telescoping arm, the flexible leg support providing lateral support for a patient's leg, and a footrest coupled to the second end of the telescoping arm and the flexible leg support, wherein the flexible leg support includes a flexion rod, a chain adjacent the flexion rod, and a foam outer covering.

2. The support apparatus of claim 1, wherein the flexible leg support defines an arc between the first and second ends of the telescoping arm to define an angle of curvature that changes as a length of the telescoping arm changes.

3. A support apparatus for use with a birthing bed, the apparatus comprising a telescoping arm, a flexible leg support having a first end coupled to a first end of the telescoping arm and a second end coupled to a second end of the telescoping arm, the flexible leg support providing lateral support for a patient's leg, a footrest coupled to the second end of the telescoping arm and the flexible leg support, and a ball-and-socket coupler configured to be coupled to a hip area of the birthing bed and coupled to the telescoping arm and flexible leg support.

4. A support apparatus for use with a birthing bed, the apparatus comprising a telescoping arm, a flexible leg support having a first end coupled to a first end of the telescoping arm and a second end coupled to a second end of the telescoping arm, the flexible leg support providing lateral support for a patient's leg, a footrest coupled to the second end of the telescoping arm and the flexible leg support, and a two-axis pivot bracket coupled to the birthing bed, the first end of the flexible leg support and the first end of the telescoping arm, wherein the flexible leg support and the telescoping arm are pivotable about a first axis parallel to a length of the birthing bed and a second axis perpendicular to the first axis.

5. The support apparatus of claim 4, wherein the telescoping arm and flexible leg support are pivotable relative to the birthing bed about the first axis between a first, use position, above a deck of the birthing bed and a second, stowed position, beneath the deck of the birthing bed.

6. The support apparatus of claim 4, further comprising a release handle coupled to the second end of the flexible leg support and the telescoping arm, and a cable coupled to the release handle such that movement of the release handle and cable with the release handle releases the two-axis pivot bracket to permit the support apparatus to be adjusted.

7. The support apparatus of claim 6, wherein the flexible leg support includes a passageway between the first end of the flexible leg support and the second end of the flexible leg support and the cable is received within the passageway of the flexible leg support.

8. The support apparatus of claim 4, wherein the telescoping arm and flexible leg support are pivotable about the second axis to position the telescoping arm in a generally vertical position perpendicular to a patient support surface of the birthing bed.

9. An apparatus for limiting abduction of a patient's leg relative to a patient-support device, the apparatus comprising an extendable and retractable arm coupleable to the patient support device, a flexible member coupled to the arm and defining an arc to serve as an abduction barrier, wherein an angle of curvature of the arc changes as the extendable and retractable arm extends and retracts, and a ball-and-socket coupler configured to be coupled to a hip area of the birthing bed and coupled to the extendable and retractable arm.

10. A stirrup apparatus for use on a birthing bed, the stirrup apparatus comprising a telescoping arm having a first end configured to be coupled to the bed and a second end, the telescoping arm being adjustable in length between a fully retracted position and a fully extended position, an abduction barrier coupled at a first end to the first end of the telescoping arm and at a second end to the second end of the telescoping arm, the abduction barrier including a flexion rod and a chain adjacent the flexion rod, and a footrest coupled to the second end of the telescoping arm.

11. The stirrup apparatus of claim 10, wherein the telescoping arm is a fluid cylinder.

12. The stirrup apparatus of claim 11, wherein the fluid cylinder is pneumatic.

13. The stirrup apparatus of claim 11, wherein the fluid cylinder is hydraulic.

14. The stirrup apparatus of claim 10, wherein the telescoping arm is a linear actuator.

15. The stirrup apparatus of claim 10, wherein the abduction barrier is flexible and is curved to form an arc between the first end and the second end such that curvature of the abduction barrier changes as a distance between the footrest and the first end of the arm changes.

16. A stirrup apparatus for use on a birthing bed, the stirrup apparatus comprising a telescoping arm having a first end configured to be coupled to the bed and a second end, the telescoping arm being adjustable in length between a fully retracted position and a fully extended position, an abduction barrier coupled at a first end to the first end of the telescoping arm and at a second end to the second end of the telescoping arm, a footrest coupled to the second end of the telescoping arm, and a two-axis pivot bracket coupled to the first end of the telescoping arm to define a first axis and a second axis about which the arm pivots.

17. The stirrup apparatus of claim 16, wherein the two-axis pivot bracket is lockable in a plurality of positions.

18. The stirrup apparatus of claim 17, further comprising a user input biased to maintain the stirrup apparatus locked in a first position and releasable to permit the stirrup apparatus to be adjusted to a second position.

19. An apparatus for limiting abduction of a patient's leg relative to a patient-support device, the apparatus comprising an extendable and retractable arm coupleable to the patient support device, and a flexible member coupled to the arm and defining an arc to serve as an abduction barrier, wherein the flexible member includes a flexion rod and a chain adjacent the flexion rod, and wherein an angle of curvature of the arc changes as the extendable and retractable arm extends and retracts.

20. The apparatus of claim 19, further comprising a two-axis pivot bracket coupled to the patient-support device, the flexible member, and the extendable and retractable arm, wherein the extendable and retractable arm and flexible member are pivotable about a first axis parallel to a length of the patient-support device and a second axis perpendicular to the first axis.

21. The apparatus of claim 20, wherein the extendable and retractable arm and flexible member are pivotable relative to the patient-support device about the first axis between a first, use position, above a deck of the patient-support device and a second, stowed position, beneath the deck of the patient-support device.

22. The apparatus of claim 20, further comprising a release handle coupled to the extendable and retractable arm and flexible member at an end opposite the two-axis pivot bracket, and a cable coupled to the release handle such that movement of the release handle and cable with the release handle releases the two-axis pivot bracket to permit the apparatus to be adjusted.

23. The apparatus of claim 22, wherein the flexible member further includes a passageway and the cable is received within the passageway of the flexible member.

24. The apparatus of claim 20, wherein the extendable and retractable arm and flexible member are pivotable about the second axis to position the extendable and retractable arm in a generally vertical position perpendicular to a patient support surface of the patient-support device.

* * * * *